US006161454A

United States Patent [19]

Chaconas

[11] Patent Number: 6,161,454

[45] Date of Patent: Dec. 19, 2000

[54] LOW COST RATCHET WRENCH AND METHOD OF ASSEMBLY

[75] Inventor: Peter Constantine Chaconas, Glyndon, Md.

[73] Assignee: Hand Tool Design Corporation, Wilmington, Del.

[21] Appl. No.: 09/137,258

[22] Filed: Aug. 20, 1998

Related U.S. Application Data

[63] Continuation-in-part of application No. 08/769,237, Dec. 18, 1996, abandoned.

[51] Int. Cl.[7] ..... B25B 13/46

[52] U.S. Cl. ..... 81/63.2; 81/63

[58] Field of Search ..... 81/60–63.2

[56] References Cited

U.S. PATENT DOCUMENTS 2,138,332 11/1938 Geisel ..... 81/63 X
2,978,081 4/1961 Lundin .
3,490,317 1/1970 Rozmus .
4,328,720 5/1982 Shiel .
4,336,728 6/1982 Deibert .
4,491,043 1/1985 Dempsey et al. .
4,553,453 11/1985 Dempsey et al. .
4,862,775 9/1989 Chow .
5,090,273 2/1992 Fossella .

FOREIGN PATENT DOCUMENTS 1 810 811 6/1970 Germany .

*Primary Examiner*—James G. Smith
*Attorney, Agent, or Firm*—Leonard Bloom

[57] ABSTRACT

A ratchet wrench having three interconnected openings formed therein. A ratchet gear is disposed in the first opening which has an access opening to the bottom surface of the wrench. A pawl is pivotally disposed in the second opening. A lever member is pivotally disposed in the third opening. A detent mechanism is carried by the lever member to engage the pawl. A lever arm is connected to the lever member and movement of the lever arm moves the lever member and detent mechanism for forward and reverse ratcheting. A method of assembly of the wrench is disclosed.

25 Claims, 12 Drawing Sheets

LOW COST RATCHET WRENCH AND METHOD OF ASSEMBLY

CROSS REFERENCE TO RELATED APPLICATION

The present invention is a continuation-in-part of application Ser. No. 08/769,237, filed Dec. 18, 1996 now abandoned.

BACKGROUND OF THE INVENTION

The present invention relates to a ratchet wrench and a method of assembling the wrench, and more particularly to a ratchet wrench having three holes formed in the head and a rotatable detent means.

Many ratchet wrenches have been produced commercially and disclosed in patents. Most of the ratchet wrenches have two openings formed in the head of the wrench, a ratchet gear being disposed in one opening and a pawl being disposed in the other opening. Also, most ratchet wrenches have a blind bore formed in the handle of the wrench and oriented toward the opening in which is the pawl and ratchet gear are disposed. A spring and ball or other detent means is disposed in the blind bore. The detent means engages pockets in the pawl as the pawl is moved between a forward and a reverse position.

Production of these ratchet wrenches is comparatively costly because of the need to machine the blind bore in the handle of the wrench and to install a ball and spring detent means in the blind bore. The creating of the bore is time consuming and difficult because the bore must be machined at an angle due to the shape of the opening in the head of the wrench. Furthermore, assembly of the spring and ball in the bore requires special tooling. Also, most ratchet wrenches are made by forging and then milling openings in the head of the wrench and assembling the wrenches by inserting the ratchet gear and pawl from the top or bottom of the wrench. The detent means must be inserted laterally and within the bores and then held for pawl insertion. This also increases production costs. The applicant is aware of the following patents which do not have some of these limitations.

U.S. Pat. No. 2,978,081 to Lundin discloses a ratchet wrench having a head with removable top and bottom cover plates over two through holes. A manipulator has a ball and spring detent means mounted above the body of the wrench which pivots the detent means.

U.S. Pat. No. 3,490,317 to Rozmus discloses a ratchet wrench with three chambers, two of which accommodate drive gears. A reversible ratchet locking mechanism includes a pawl in a third cylindrical chamber and plunger biased by a spring which is disposed in a bore in the handle communicating with the third chamber. A lever moves the pawl to a selected position with respect to the plunger.

U.S. Pat. No. 4,328,720 to Shield discloses a socket wrench having three cavities in the head-handle, which is an integral piece only one of the cavities is cylindrical and the ratchet gear is disposed therein. The pawl is adjacent to the ratchet gear. An interior lever which contacts the pawl is in the third cavity and is controlled by an external latch handle. The device does not have a detent means within the interior lever. A cover is disposed over the cavities.

Diebert, in U.S. Pat. No. 4,336,728 discloses a reversible ratchet wrench having three partially overlapping recesses in the head with a toothed wheel in one recess, a pawl in an adjacent recess, and an actuator in the third recess. The actuator is driven by cams to engage the pawl and to determine the direction of rotation of the ratchet wheel. The pivotally mounted actuator carries a detent means in a bore within the actuator.

Dempsey et al, U.S. Pat. Nos. 4,491,043 and 4,553,453 disclose a wrench having three substantially cylindrical chambers having overlapping areas. A wheel placed in the first chamber communicates with a shifter pin in the second chamber. The shifter pin is manipulated by a knob in the third chamber.

Chow, in U.S. Pat. No. 4,862,775, discloses a ratchet wrench having an upper cover plate and a lower cover plate on a housing. A ratchet wheel, a pawl and a bifurcated control element are disposed in the housing. A resilient sheet is arranged between the pawl and the control element. The control element is pivoted in the housing and is manipulated by a button which slides, externally of the upper cover plate, through a slot in the upper cover plate.

U.S. Pat. No. 5,090,273 issued to Fossella discloses a ratchet wrench having three interconnecting chambers. One chamber is a through opening in which a toothed wheel is disposed. A pawl is received in one blind chamber and a pawl switching lever is disposed in the other blind chamber. The pawl switching lever is a spring-loaded plunger.

German Registration No. 1810811, June 1970 discloses a ratchet wrench having a detent means in a bore in the handle. The detent means engages alternate pockets in the rear face of a yoke. The yoke carries a tube with a ball and spring. The tube is connected to the pawl by a pin so that rotation of the yoke produces movement of the pawl between a forward and a reverse position.

These patents have existed for numerous years and have not achieved commercial success. There exists a need for a ratchet wrench which can be produced more economically.

BRIEF SUMMARY OF THE INVENTION

It is an object of the present invention to provide a ratchet wrench which does not require the boring of an opening for a detent means, which can be assembled from the top surface and which is economical to manufacture and repair.

It is another object of the invention to provide a ratchet wrench which is moved between a forward and a reverse position by pivoting of the detent means.

In accordance with the teachings of the present invention, there is described a ratchet wrench comprising a handle including a head portion having substantially parallel planar surfaces including a top surface and a bottom surface. The top surface has a plurality of intercommunicating openings formed therein and including a first opening having a portion communicating with the bottom surface, a second opening rearwardly of the first opening, and a third opening rearwardly of the second opening, respectively. A ratchet gear is disposed in the first opening. A pawl is pivotally disposed in the second opening engaging the ratchet gear. A lever member is pivotally disposed in the third opening. The lever member carries a detent means avoiding a blind bore formed in the handle to receive the detent means. The detent means engages a pocket formed in the pawl. The lever member has a manually-manipulatable portion extending outwardly from the third opening toward the handle. In this manner, movement of the manually manipulatable portion of the lever member produces concomitant movement of the detent means to move the pawl between a forward and a reverse position.

In further accordance with the teachings of the present invention, there is disclosed a ratchet wrench including a handle having a head portion unitary therewith. At least one opening is formed in the head portion. A ratchet gear and a pawl engaging the ratchet gear are disposed in the at least one opening in the head portion. The pawl has at least one pocket formed in a side thereof opposite from the ratchet gear. A further opening is formed in the head portion communicating with the at least one opening and the at least one pocket on the pawl. A lever member is pivotally disposed in the further opening. The lever member has a detent means positioned therein. The detent means is oriented toward the at least one pocket in the pawl. The lever member has an arm extending outwardly from the further hole toward the handle. In this manner, movement of the lever arm in a first direction and in an opposite second direction engages the detent means with the at least one pocket on the pawl to provide forward and reverse drive to the ratchet gear.

In another aspect, there is disclosed a method of assembling a ratchet wrench comprising the steps of forming a wrench body having a handle and an integral head portion. The head portion has a top planar surface and a bottom planar surface. A plurality of openings are formed in the top surface of the head portion, including a first opening having a portion communicating with the bottom surface, a second opening, rearwardly of and communicating with, the first opening, and a third opening rearwardly of and communicating with the second opening. From the direction of the top surface, a ratchet gear is disposed into the first opening. A pawl is disposed in the second opening. The pawl has teeth oriented toward the ratchet gear and at least one pocket oriented toward the third opening. A lever member is disposed into the third opening. The lever member carries a detent means. The detent means is oriented toward the at least one pocket on the pawl. Pivotal means are formed on the wrench. The lever member is disposed on the pivotal means wherein the lever member may be pivoted such that the detent means engages the at least one pocket on the pawl.

These and other objects of the present invention will become apparent from a reading of the following specification taken in conjunction with the enclosed drawings.

BRIEF DESCRIPTION OF THE DRAWINGS

FIG. 15 shows the rough cast openings in the head being bored smooth by a cutting tool.

FIG. 16 shows the wrench formed with three smooth finished interconnected openings formed therein.

FIG. 17 shows insertion of the pawl into the second opening.

FIG. 18 shows insertion of the lever member into the third opening.

FIG. 19 shows insertion of the detent means into the lever member.

FIG. 20 shows insertion of the ratchet gear into the first opening.

FIG. 21 shows disposition of the cover plate on the wrench.

FIG. 22 shows the assembled wrench.

DESCRIPTION

Figure 1:
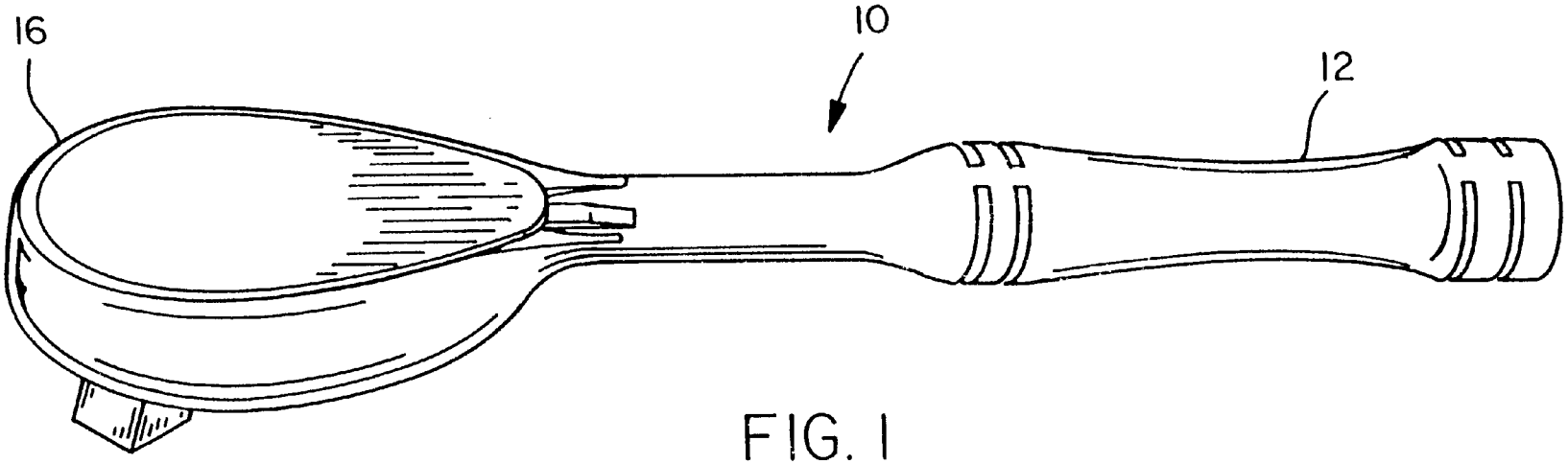
FIG. 1 is a perspective view of the wrench of the present invention.
Figure 2:
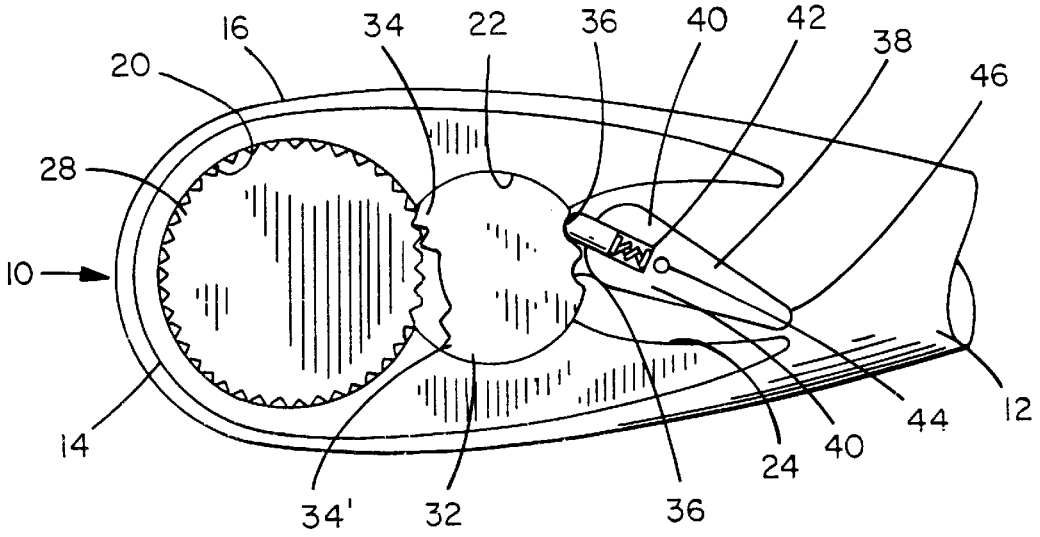
FIGS. 2–6 are a sequence of top plan views of the wrench with the cover removed showing pivoting of the lever on a pin boss and engaging one or the other pockets in the pawl.
Figure 3:
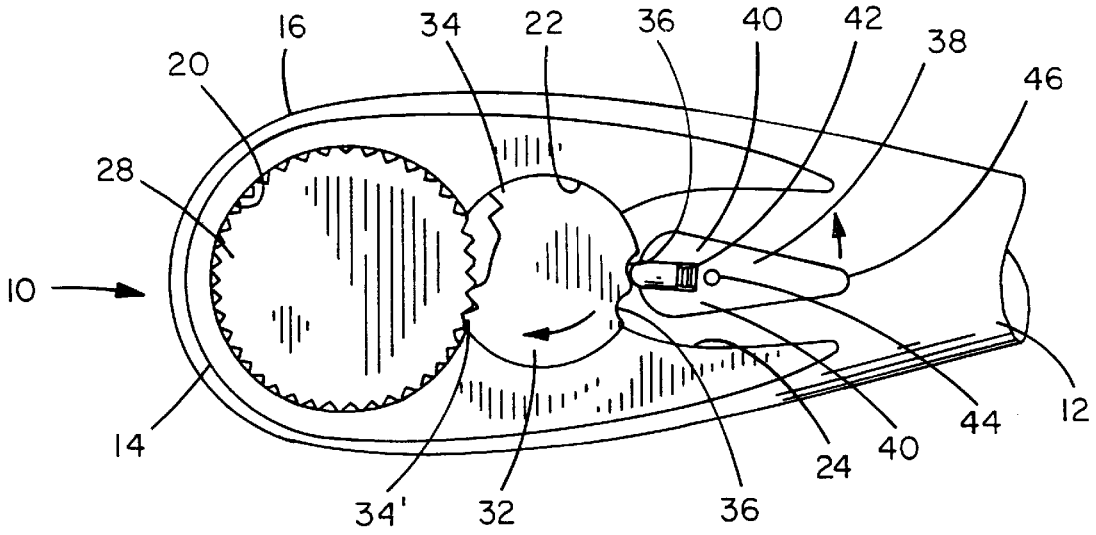
Figure 4:
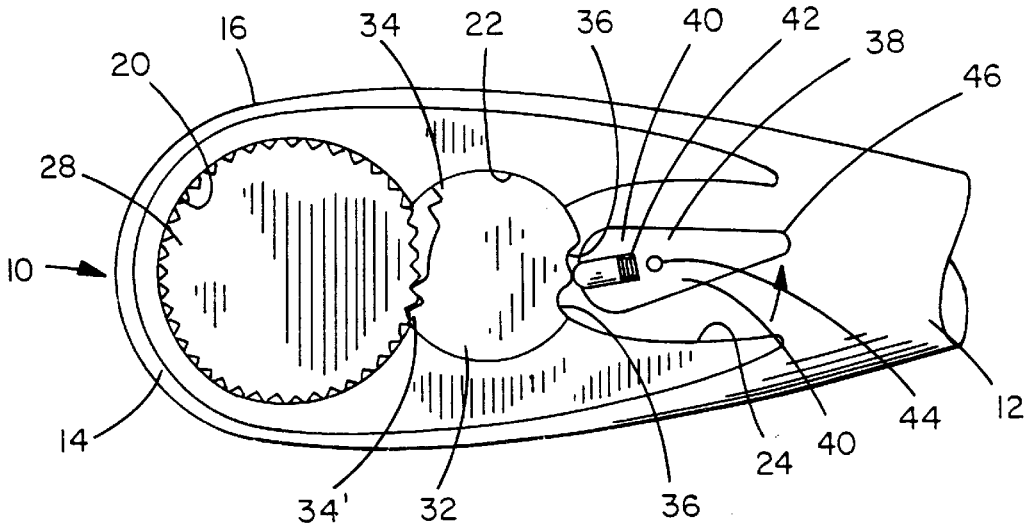
Figure 5:
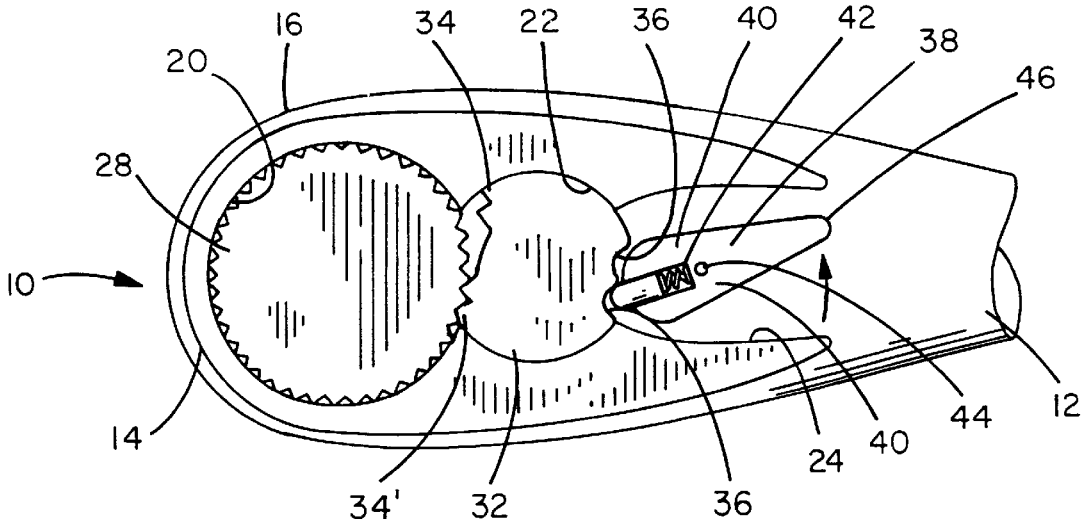

Referring now to FIGS. 1–9, a first embodiment of the ratchet wrench 10 is shown. The wrench 10 has a handle portion 12 integral with a head portion 14. The head portion 14 has substantially parallel planar surfaces, a top surface 16 and a bottom surface 18. The top surface 16 has a plurality of interconnected openings formed therein. A first opening 20 is formed distal from the handle 12. A second opening 22 is formed as an axial blind bore rearwardly (between the first opening and the handle) of the first opening 20. The first opening 20 and the second opening 22 communicate with one another. A third opening 24 is formed as an axial blind bore proximal to the handle 12 and rearward of the second opening 22. Preferably, the third opening 24 is elongated and is wider proximal to the second opening and is more narrow proximal to the handle. The second opening 22 and the third opening communicate with one another. An access opening 26 is formed in the bottom surface 18 of the head. The access opening 26 communicates with the first opening 20.

A ratchet gear 28 is disposed in the first opening 20. Preferably, the ratchet gear 28 has a drive means such as a tang 30 formed thereon, the drive tang extending through the access opening 26, the cover 48, and beyond the bottom surface 18 (or top surface 16) of the head. Alternately, the drive means may be an axial opening 31 formed in the ratchet gear 28 to receive therein a fastener or similar workpiece through the access opening 26. The axial opening 31 has surfaces therein to engage a fastener. This embodiment provides a ratchet wrench with a low profile.

A pawl 32 is pivotally disposed in the second opening 22. The pawl 32 has two sets of teeth 34 on a front face which are oriented toward the ratchet gear 28 and engage the teeth on the ratchet gear 28 as determined by the pivotal disposition of the pawl 32. In the first embodiment, the pawl 32 has a pair of adjacent pockets 36 formed axially in the back face of the pawl 32 opposite from the teeth 34 so that the pockets 36 are oriented toward the third opening 24. The pockets 36 are substantially parallel to the outside walls of the pawl 32. A divider separates the pockets. The walls of the second opening 22 are preferably adjacent to the outside walls of the pawl 32 such that the pawl 32 may pivot within the second opening without the need for a pivot pin. The outside walls of the pawl 32 serve as the axle for the pivotal movement. However, a pivot pin may be formed in the bottom of the second opening 22 so that the pawl may pivot thereabout if desired.

Figure 9:
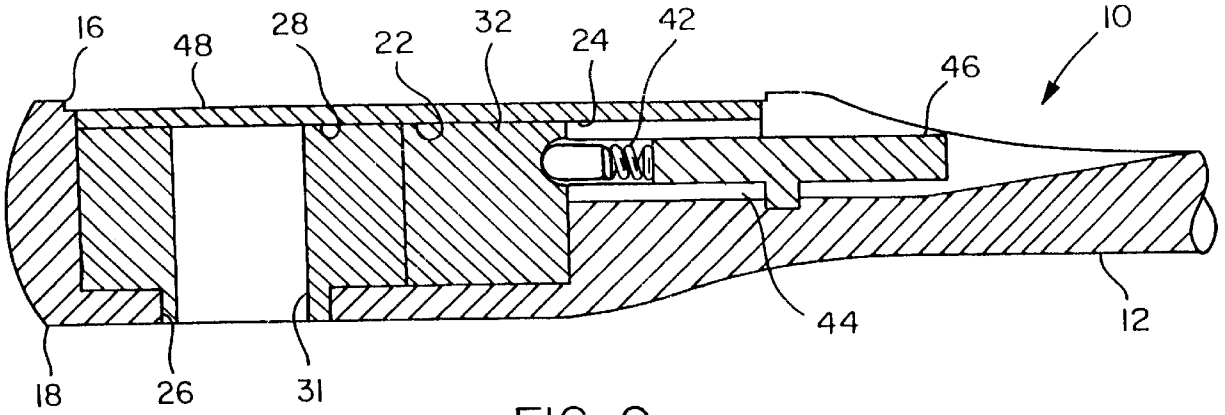
FIG. 9 is a partial cutaway cross-sectional view wherein the pin boss is formed on the lever member and received in a bore in the wrench.

A lever member 38 is pivotally disposed in the third opening 24 in a plane substantially parallel to the longitudinal axis of the handle 12. It is preferred that the lever member 38 has bifurcated legs 40 which are oriented toward the pawl 32 in the second opening 22. The lever member 38 is elongated and wider across the bifurcated leg portion and more narrow proximal to the handle. There is clearance within the third opening 24 for the bifurcated legs 40 to move transversely within the third opening 24. A detent means 42 is positioned in the space between the bifurcated legs 40. Alternately, in place of the bifurcated legs, the lever member 38 may have a portion in which a blind bore is formed such that the bore is oriented toward the pawl. A detent means is retained in the blind bore. If desired, the outer rim of the blind bore may be swaged to retain the detent means within the blind bore. In either alternative, the detent means may be a spring and ball, a spring and plunger, a resilient plastic device or other resilient means known to persons skilled in the art. The detent means is urged against one of the pockets 36 in the pawl 32. In the first embodiment (FIG. 7), a pin boss 44 is formed on the handle 12 adjacent to the third opening 24 and projecting upwardly. A bore in the lever member 38 receives the pin boss 44 for pivotal movement of the lever member 38 about the pin boss 44. The lever member 38 further has a lever arm 46 connected to the bifurcated legs 40 or the portion having the detent means. The lever arm 46 extends outwardly from the third opening beyond the pin boss 44 toward the handle 12. A recess is formed in the handle 12 to permit disposal and movement of the lever arm 46. In this manner, the lever arm 46 does not project above the plane of the top surface 16 of the head portion 14, reducing the profile of the wrench 10. Alternately, as shown in FIG. 9, the pin boss 44 may be formed on the lever member 38 and the bore may be formed in the wrench to receive the pin boss 44.

Figure 6:
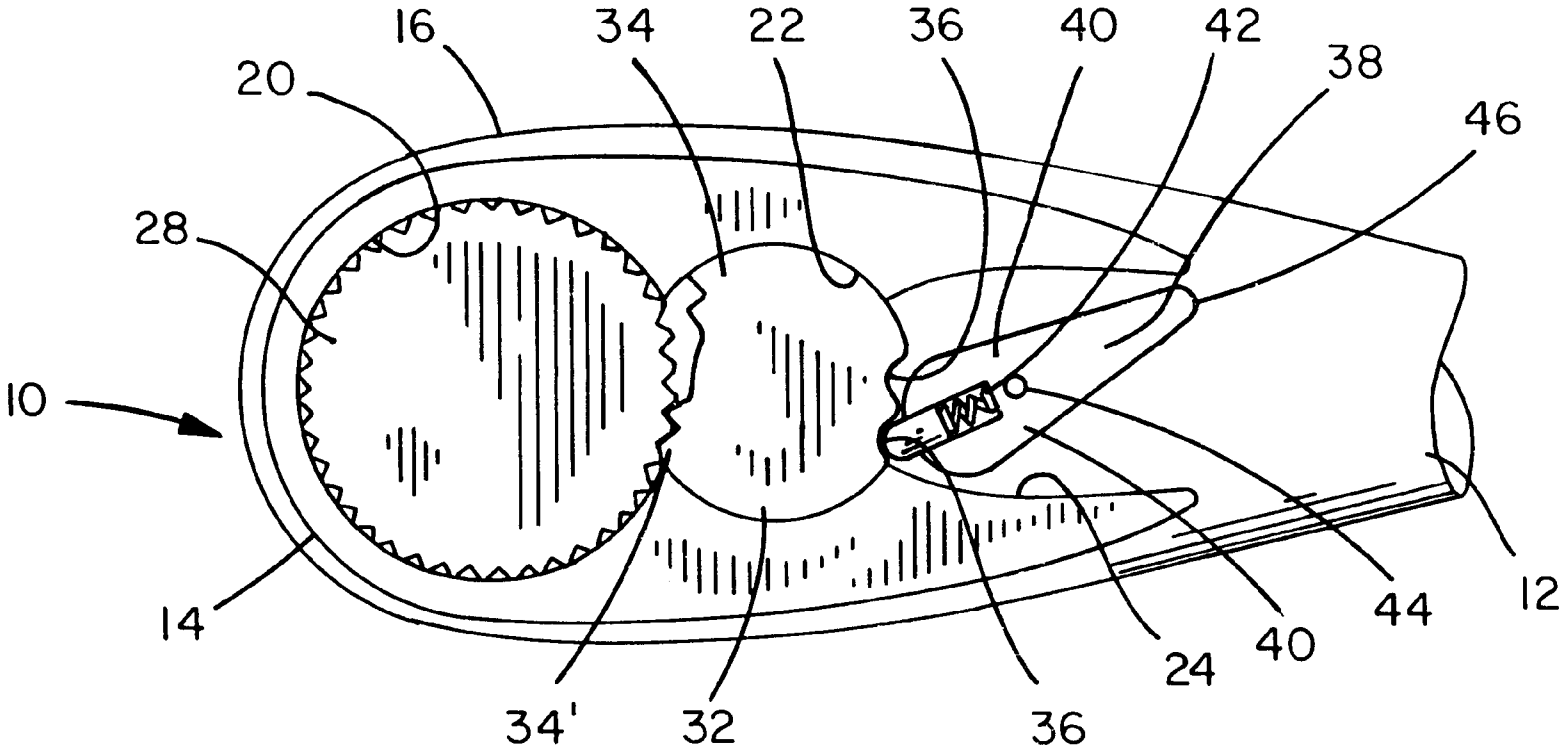
Figure 7:
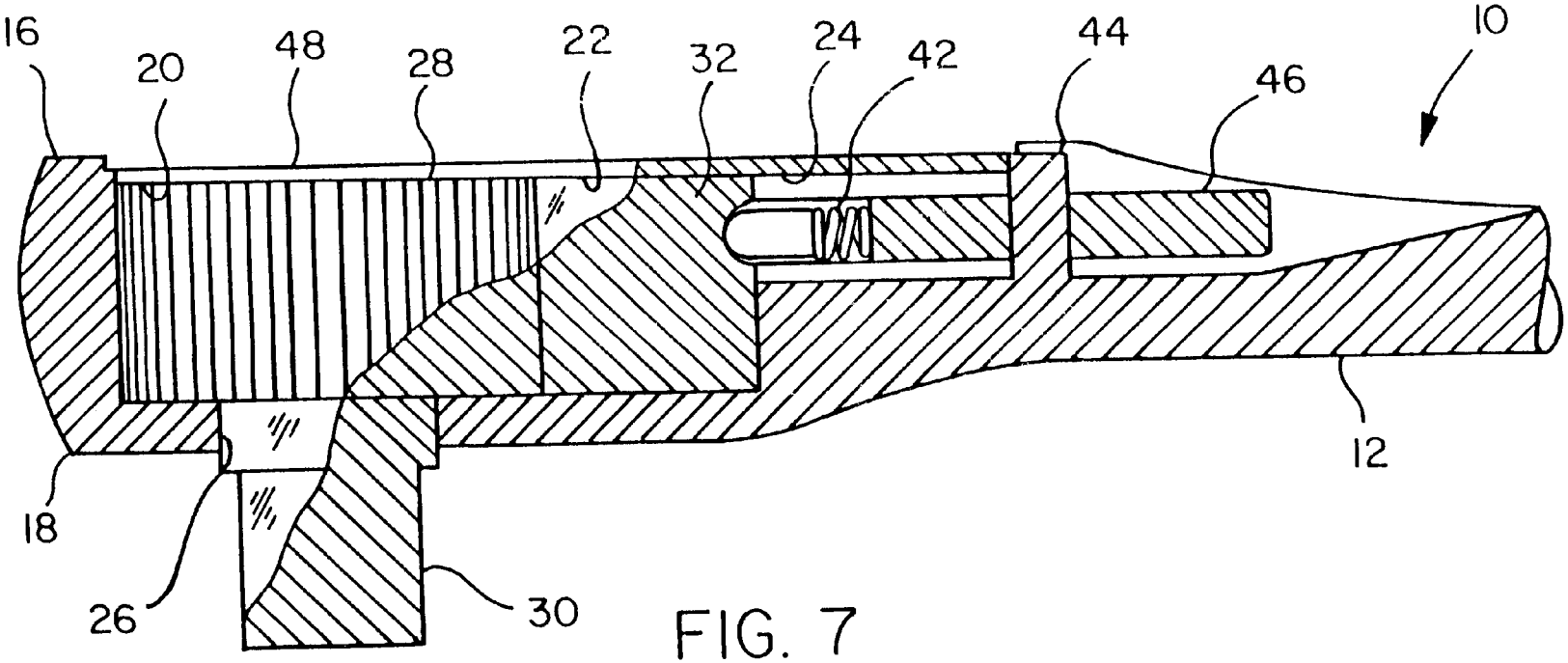
FIG. 7 is a partial cutaway cross-sectional view taken across the lines 7—7 of FIG. 2 and including the cover.
Figure 8:
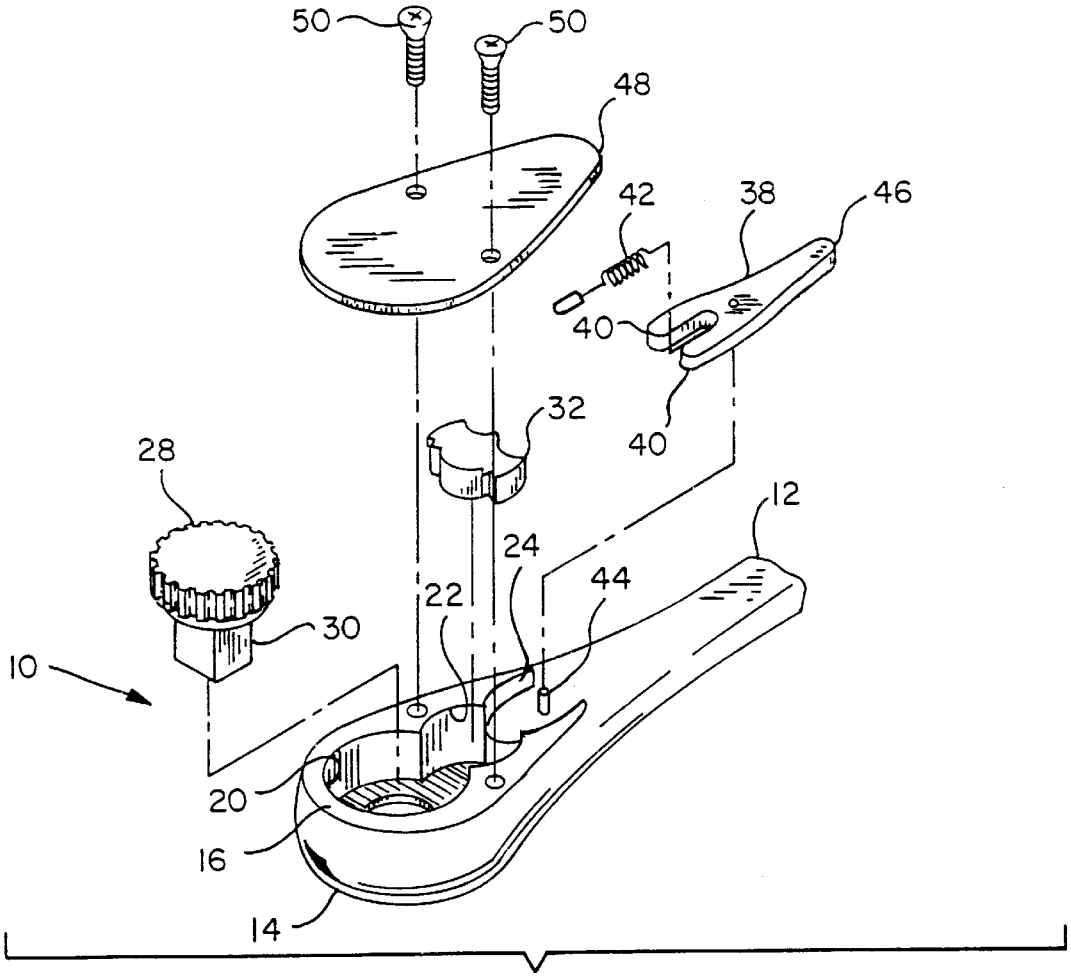
FIG. 8 is a perspective exploded view of the ratchet wrench of the present invention.

The lever arm 46 is manually manipulatable and is pivoted in a first direction and in an opposite second direction. In use, as shown in FIGS. 2–6, the detent means 42 is received in one of the pockets 36 in the pawl 32 and the pawl teeth 34 proximal to the one pocket engage the teeth on the gear 28. The distal pawl teeth 34' are in close proximity to the teeth on the gear 28 but are not engaged therewith. To reverse the direction of ratcheting, the lever member 38 is pivoted about the pin 44. The pivoting movement of the lever arm 46 (as shown by arrows near the lever arm in FIGS. 3–5) brings the detent means 42 into contact with the divider between the pockets 36 in the pawl 32. The force applied to the divider moves the pawl (as shown by the arrows on the pawl in FIGS. 3–5) to disengage the proximal teeth 34 on the pawl and engage the distal teeth 34' on the pawl with the teeth on the gear. The pawl is thereby rotatably arrested and further pivoting of the lever member 38 compresses the spring in the detent means 42 and the lever member 38 passes the ridge in the pawl. The ball or plunger of the detent means 42 enters the other of the pockets 36 in the pawl with the lever member 38 now in the fully rotated position as shown in FIG. 6. The pawl teeth 34' proximal to the other pawl pocket engage the gear teeth and the pawl teeth 34 which previously were engaged are now disengaged from the gear teeth. This mechanism provides an over center spring force to maintain the position of the lever in the forward or reverse portion. Thus, conventional forward and reverse ratcheting of the wrench 10 is obtained by movement of the lever arm 46. However, the ratcheting is due to movement of the detent means 42 rather than due to movement of the pawl.

A cover plate 48 is disposed over the openings 20, 22, 24 to retain the ratchet gear 28, pawl 32 and lever member 38 in the head 14. Retaining means 50 secure the cover to the top surface 16 of the load. The retaining means 50 may be screws threadingly received in the head, one or more retaining rings received in an annular groove in the head above the cover plate or other means known to persons skilled in the art.

Figure 10:
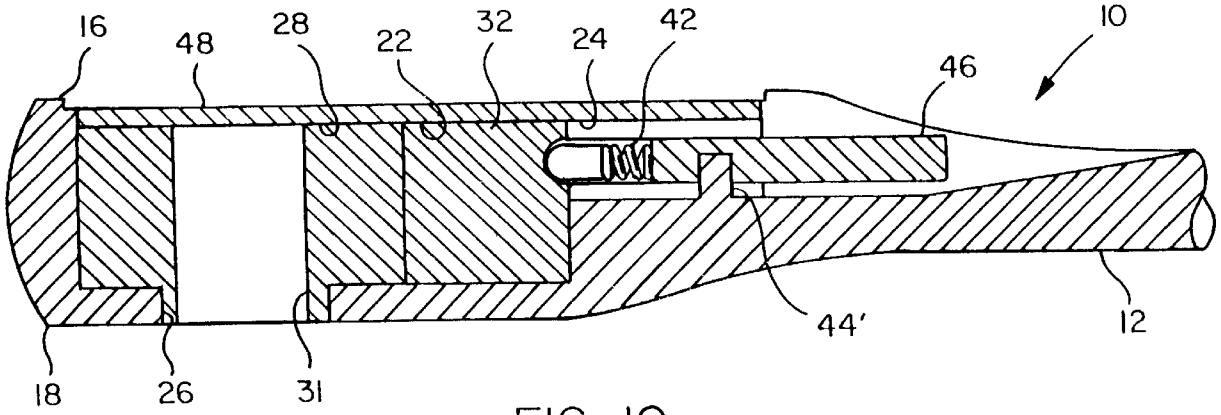
FIG. 10 is a partial cutaway cross-sectional view wherein the pin boss is disposed within the third opening and the gear ratchet having an axial opening therein.

A second embodiment, as shown in FIG. 10, is the same as the first embodiment except that the pin boss 44' is formed in the bottom of the third opening 24. The bore in the lever member 38 receives the pin boss 44' and the lever member is pivotally moved in the third opening 24. The pin boss 44' may be formed on the lever member 38 and the bore may be in the bottom of the third opening 24.

Figure 11:
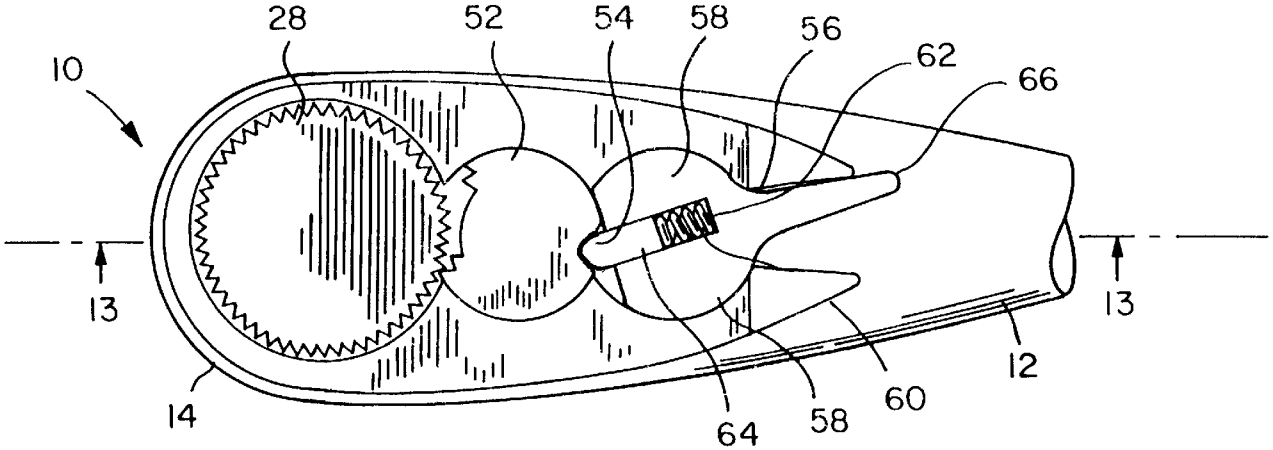
FIG. 11 is a top elevational view of another embodiment showing the lever member in the third opening and the lever oriented in a first direction.
Figure 12:
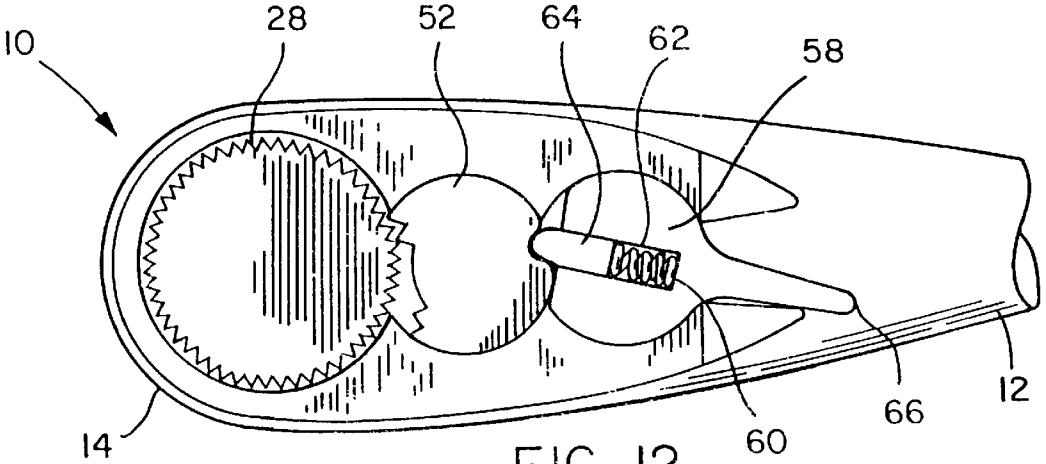
FIG. 12 is a top elevational view of the embodiment of FIG. 11 with the lever oriented in a second direction.
Figure 13:
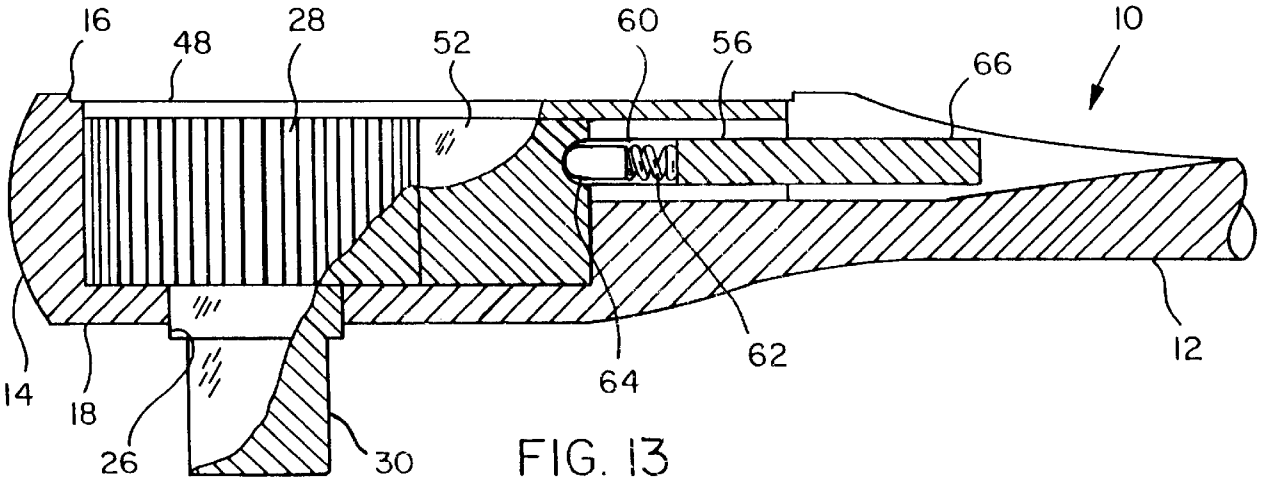
FIG. 13 is a cross-sectional view taken across the lines 13—13 of FIG. 11.

A third embodiment, as shown in FIGS. 11–13, differs from the first and second embodiments in the third opening, the pawl and the lever member. The third opening 24, preferably is circular. The pawl 52 preferably is cylindrical and has only one pocket 54 or notch formed in the side oriented toward the third opening 24 although the pawl may have two adjacent pockets. The lever member 56 is disposed in the third opening 24 such that the outside walls of the lever member are adjacent to the walls of the third opening 24 and serve as an axle for pivotal movement. The lever member 56 preferably has bifurcated legs 58 oriented toward the pocket 54 in the pawl 52. Detent means 60 are disposed in the space between the bifurcated legs 58. Alternately, in place of the bifurcated legs, the lever member may have a portion in which a blind bore is formed such that the blind bore is oriented toward the pawl. A detent means is disposed in the blind bore. In either alternative it is preferred that the detent means have a resilient means 62 such as a spring which urges a plunger 64 (or piston) into the pocket 54 in the pawl 52. The lever member 56 further has a lever arm 66 which extends outwardly from the third opening toward the handle. The lever arm 66 is moved in a first direction and an opposite second direction to pivotally move the lever member 56. The detent means 60 remains engaged in the pocket 54 and the pawl is pivotally moved concomitantly with the movement of the lever member 56. Pivotal movement of the pawl 52 alternately engages a set of teeth on the pawl 52 with the teeth in the ratchet gear 28 to provide forward and reverse movement to the ratchet gear 28.

Figure 14:
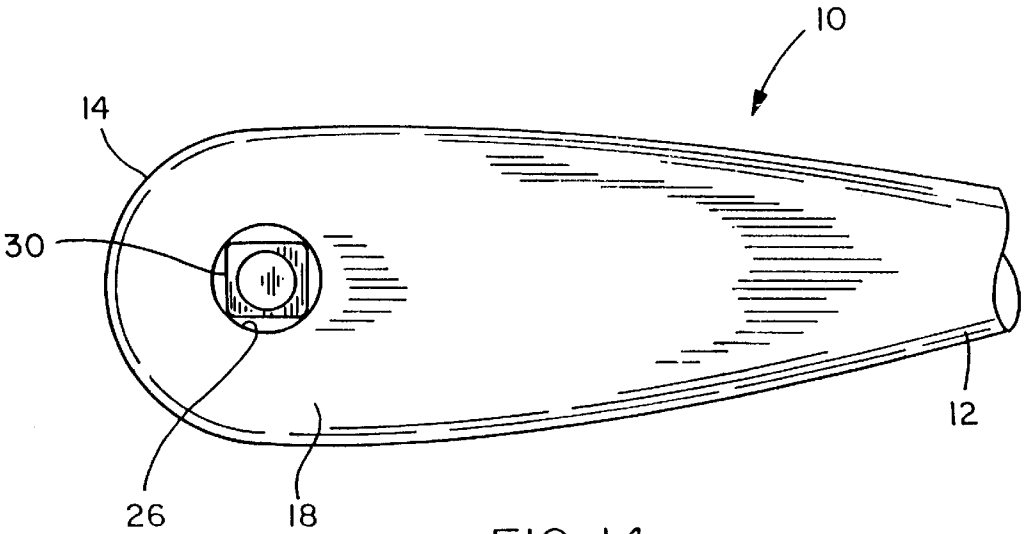
FIG. 14 is a bottom plan view of the ratchet wrench of the present invention.
Figure 15:
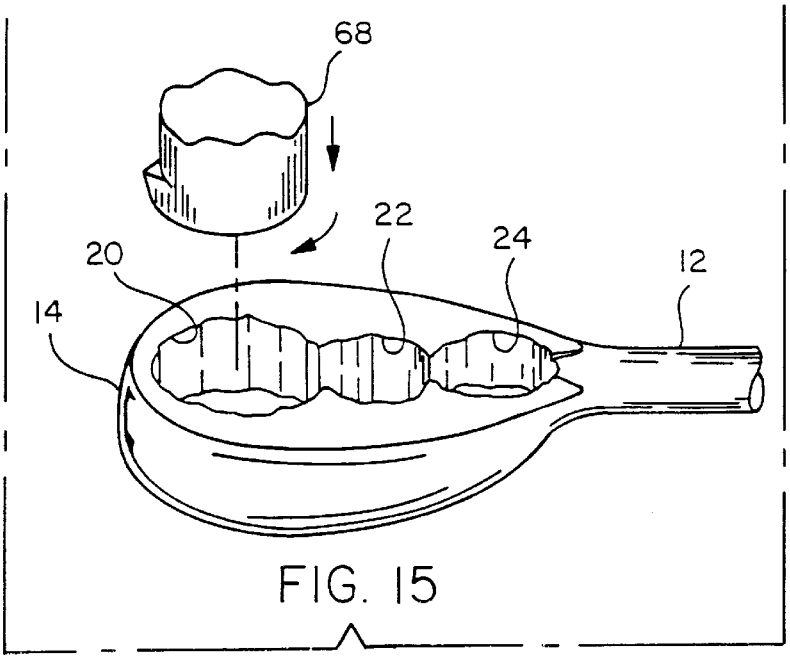
FIGS. 15–22 are a sequence of perspective views showing a method of assembly of the ratchet wrench of the present invention.
Figure 16:
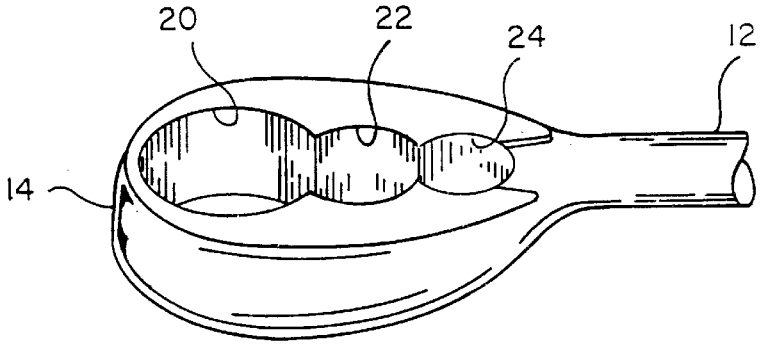
Figure 17:
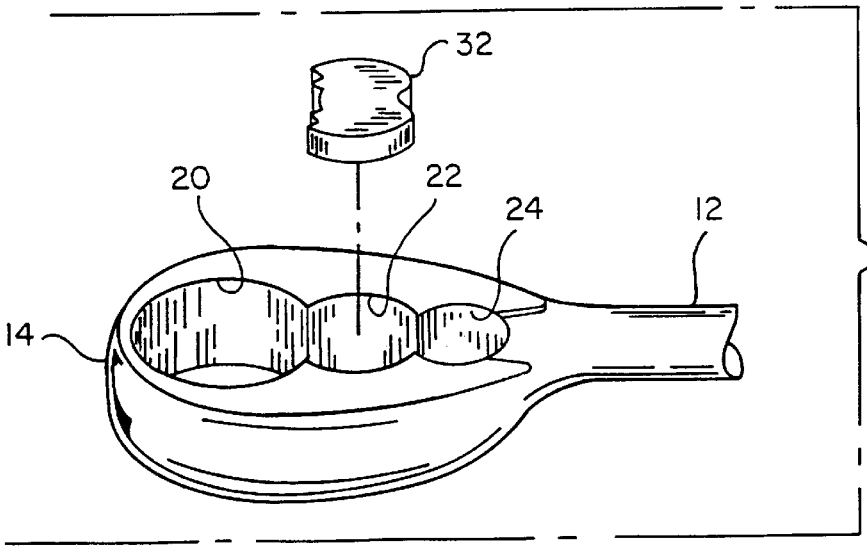
Figure 18:
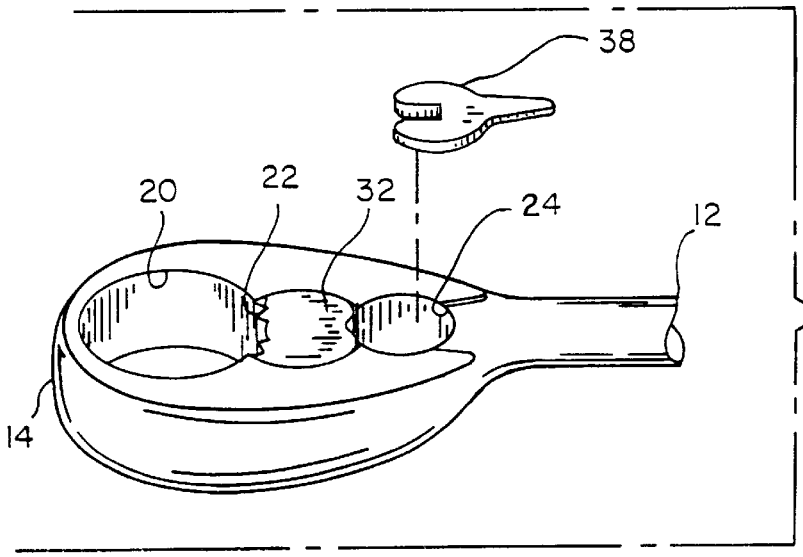
Figure 19:
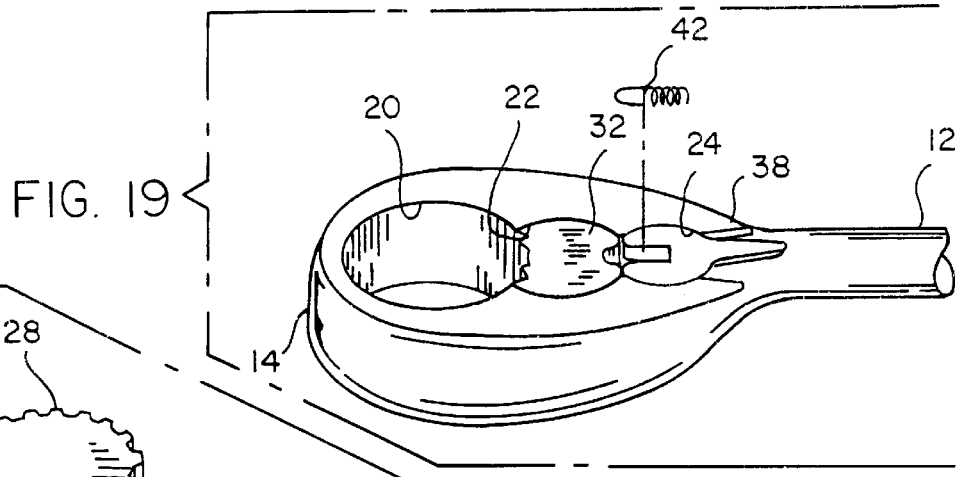
Figure 20:
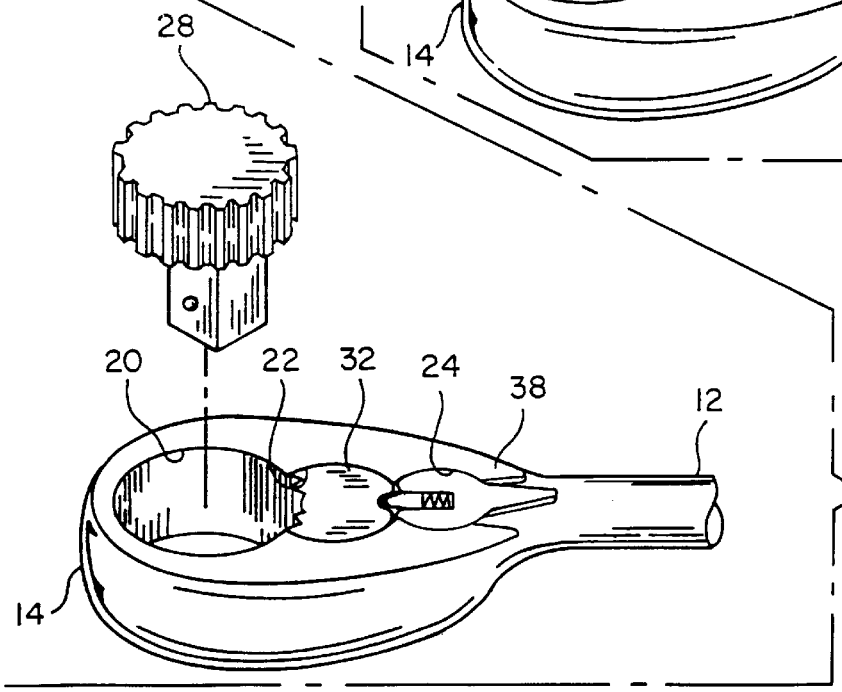
Figure 21:
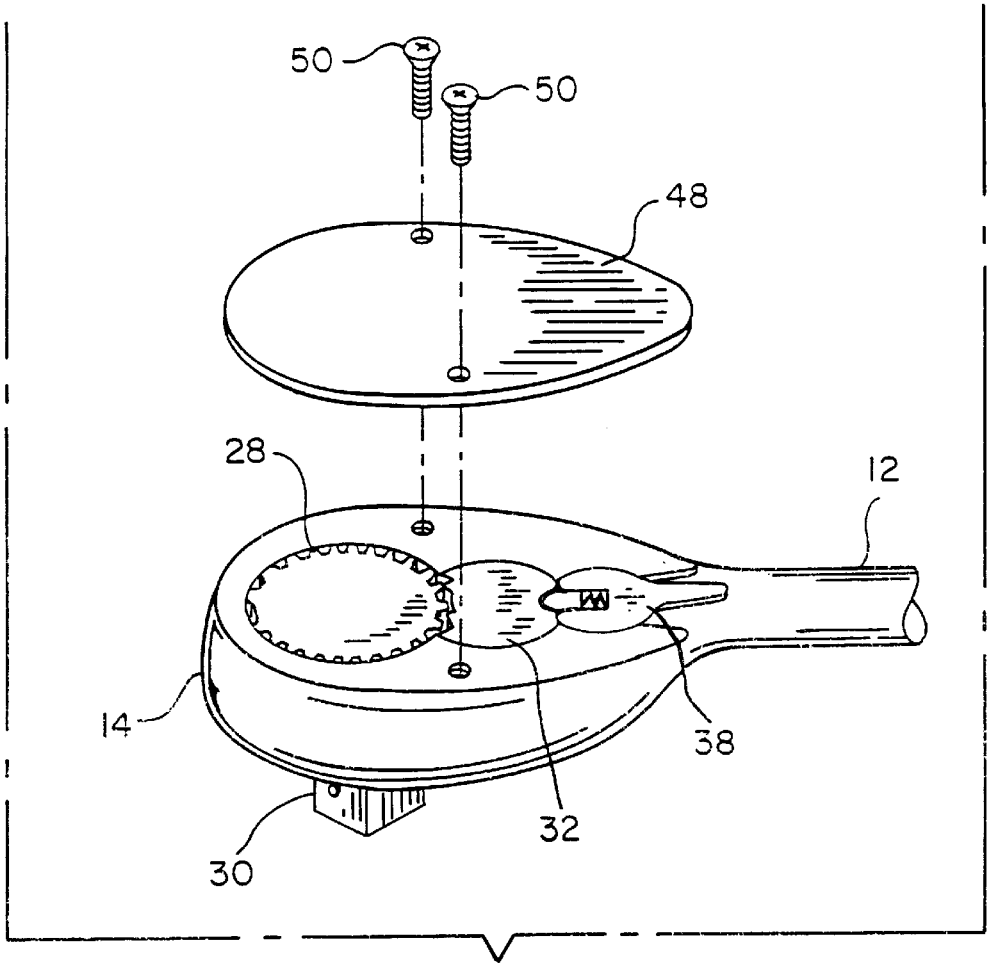
Figure 22:
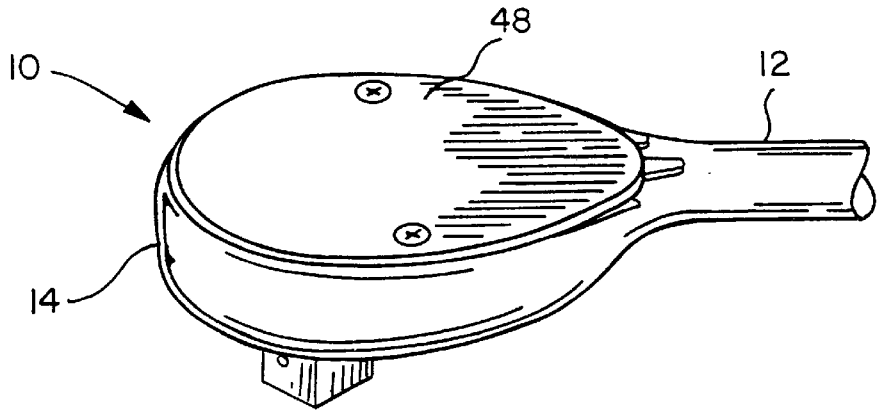

The bottom surface of the wrench, as shown in FIG. 14, is the same in all the embodiments. The access opening 26 permits a drive tang 30 to extend therethrough. Alternately, the access opening 26 permits a fastener or workpiece to be received in an axial opening in the ratchet gear.

The wrench 10 is made and assembled as shown in the sequence of FIGS. 15–22. The handle and head are molded, cast, forged or investment cast as an integral unit. The three openings in the head may be formed in the forming process and/or are milled to tolerance from the top surface of the wrench using an appropriate tool 68. Alternately, the three openings may be formed by directly machining the head. All machining may be performed from a single setup.

The order of insertion of components into the openings in the head of the wrench is not critical. A preferred order is to insert the pawl 32, 52 into the second opening from the direction of the top surface 16. The lever member 38, 56 is inserted into the third opening 24 from the direction of the top surface 16 with the lever arm 46, 66 oriented toward the handle 62 of the wrench. Preferably, the detent means 42, 60 is disposed in the space between the bifurcated legs 40, 58 after the lever member 38, 56 is disposed in the third opening 24. Alternately, the detent means 42, 60 may be disposed in the space between the bifurcated legs 40, 58 or, alternately, in the blind bore in the member of the lever member before inserting the lever member into the third opening. This alternative assembly method may be more difficult and costly because of the need to compress the resilient means while inserting the lever member onto the third opening. The ratchet gear 28 is disposed in the first opening 20 from the direction of the top surface of the wrench. The cover plate 48 is placed on a ledge on the top surface of the wrench covering the ratchet gear, the pawl and the lever member in the three openings. The cover plate 48 is secured to the wrench. At least two screws may be used to retain the cover plate 48 to the top surface of the wrench by being threadingly received in corresponding openings in the cover plate and in the head of the wrench. Alternately, annular grooves may be formed in the openings near the top surface. The cover plate is disposed on a ledge below the annular grooves and one or more retaining rings disposed on top of the cover plate engaging the annular grooves. In another alternative, an end of the cover plate may be disposed in a groove in the opening and a single retaining ring placed at the opposite end of the cover plate to secure the cover plate to the head.

The ratchet wrench of the present invention provides many advantages over the prior art. Most significant are the reduction in cost which is achieved by several features of the design. The costly and time consuming forming of a blind bore for a detent means in the handle communicating with the opening in the head has been eliminated. This manufacturing step required special tooling, manipulation of the wrench body to permit machining the bore, and close tolerances. The present device disposes the detent means in the lever member without the special tooling or manipulation. The three openings in the head are formed simultaneously by molding or casting of the wrench. Only milling the openings to required tolerances is additionally required. In the present invention, all of the components are disposed into the head of the wrench from the top surface. There is no wasted time or motion in inverting, turning or rotating the body of the wrench to insert one component from one direction and another component from a different direction.

Repairs are easily and economically performed by removal of the cover plate which provides immediate and direct access to all components of the wrench. A low profile wrench is provided. The forward/reverse lever is below the top surface of the head. If used with a gear having an axial opening, there is no tang extending from the head of the wrench and the total profile is the height of the head between the upper and lower surface. There is no axial opening in the pawl to receive the stem of a lever so the time and costs in forming an axial opening in the pawl are saved.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A ratchet wrench comprising a handle including a head portion having substantially parallel planar surfaces including a top surface and a bottom surface, the top surface having a plurality of intercommunicating openings formed therein and including a first opening having a portion communicating with the bottom surface, a second opening rearwardly of the first opening, and a third opening rearwardly of the second opening, respectively, the first opening having a ratchet gear disposed therein, the second opening having a pawl pivotally disposed therein and engaging the ratchet gear, the third opening having a lever member pivotally disposed therein, the lever member carrying a detent means, the detent means engaging a pocket formed in the pawl, avoiding a blind bore formed in the handle to receive the detent means, the lever member having a manually-manipulatable portion extending outwardly from the third opening toward the handle, wherein movement of the manually-manipulatable portion of the lever member produces concomitant movement of the detent means to move the pawl between a forward and a reverse position.

2. The ratchet wrench of claim 1, wherein the first and second openings are cylindrical and the third opening is elongated.

3. The ratchet wrench of claim 1, wherein the first, second and third openings are cylindrical.

4. The ratchet wrench of claim 1, wherein the third opening is cylindrical and the lever member is cylindrical having side walls, the side walls serving as an axle for pivotal movement of the lever member within the third opening.

5. The ratchet wrench of claim 1, wherein the lever member pivots about a pin boss.

6. The ratchet wrench of claim 5, wherein the pin boss is formed on the wrench, the lever member having a bore therein to receive the pin boss.

7. The ratchet wrench of claim 5, wherein the pin boss is formed on the lever member, the wrench having a bore formed therein to receive the pin boss.

8. The ratchet wrench of claim 1, further comprising a cover plate secured to the top surface of the head portion and retaining the ratchet gear, pawl and lever member therein.

9. The ratchet wrench of claim 1, wherein the lever member has bifurcated legs, the detent means being retained between the bifurcated legs.

10. The ratchet wrench of claim 1, further comprising the ratchet gear having a drive tang extending through the communicating portion of the first opening and beyond the bottom surface of the head portion.

11. The ratchet wrench of claim 1, further comprising the ratchet gear having an axial opening therein, the axial opening receiving therein a workpiece.

12. The ratchet wrench of claim 1, wherein the head portion has a top surface in a plane, the arm of the lever member being below the plane of the top surface.

13. A ratchet wrench comprising a handle having head portion unitary therewith, a first opening and a second opening being formed in the head portion, a ratchet gear and a pawl engaging the ratchet gear being disposed in the first opening and the second opening respectively in the head portion, the pawl being cylindrical and the second opening being circular for rotatable journaling the pawl, the pawl having at least one pocket formed in a face thereof opposite from the ratchet gear, a further opening formed in the head portion communicating with the second opening and the at least one pocket on the pawl, a lever member pivotally disposed in the further opening, the lever member having a detent means positioned therein, the detent means being oriented toward the at least one pocket in the pawl, the lever member having a manually-manipulatible portion, wherein movement of the manually-manipulatible portion in a first direction and in an opposite second direction moves the detent means that engages the at least one pocket in the pawl and rotates the pawl concomitantly to provide forward and reverse drive to the ratchet gear.

14. The ratchet wrench of claim 13, wherein the head portion has a top surface and a bottom surface, the at least one opening and the further opening being formed in the top surface, the at least one opening having a portion communicating with the bottom surface of the head of the wrench.

15. The ratchet wrench of claim 14, further comprising a cover plate secured to the top surface of the head portion and retaining the ratchet gear, the pawl and the lever member in the head portion.

16. The ratchet wrench of claim 13, wherein the further opening is elongated, and the lever member is elongated, the lever member having a pair of bifurcated legs oriented toward the pawl, the detent means being retained between the bifurcated legs.

17. The ratchet wrench of claim 13, wherein the at least one opening comprises a first opening and a second opening rearwardly of the first opening and communicating with the first opening, the ratchet gear being disposed in the first opening and the pawl being disposed in the second opening.

18. The ratchet wrench of claim 13, wherein the further opening is cylindrical and the lever member is cylindrical having side walls, the side walls serving as an axle for pivotal movement of the lever member within the third opening.

19. The ratchet wrench of claim 13, wherein a pin boss is formed adjacent to the further opening on the handle of the wrench, the lever member being pivotally mounted on the pin boss.

20. The ratchet wrench of claim 13, wherein a pin boss is formed on a bottom surface of the further opening, the lever member being pivotally mounted on the pin boss.

21. The ratchet wrench of claim 13, wherein the head portion has a top surface in a plane, the arm of the lever member being below the plane of the top surface.

22. A ratchet wrench comprising a handle including a head portion having substantially parallel planar surfaces including a top surface and a bottom surface, the top surface having a plurality of openings formed therein and including a first opening having a portion communicating with the bottom surface, a second opening rearwardly of the first opening, and a third opening rearwardly of the second opening, respectively, a ratchet gear disposed in the first opening and having a drive tang extending through the communicating portion of the first opening and beyond the bottom surface of the head portion of the handle, a pawl pivotally disposed in the second opening and engaging the ratchet gear, a lever member pivotally disposed in the third opening and including a resilient element alternately engaging respective detents formed in the pawl, a cover plate secured to the top surface of the head portion of the handle and retaining the ratchet gear, pawl and lever subassembly therein, and the lever subassembly having a manually-manipulatable portion extending through an opening in the cover plate.

23. In a ratchet wrench, the combination of an integral unitary handle having a head portion defined by top and bottom surfaces, respectively, the top surface having a plurality of respective openings formed therein, including a first opening having a portion communicating with the bottom surface, a second opening rearwardly of the first opening, and a third opening rearwardly of the second opening, the head portion of the integral unitary handle having a pivot pin projecting upwardly thereof and into the third opening therein, a ratchet gear disposed in the first opening and including an integral drive tang extending through the communicating portion of the first opening and beyond the bottom surface, a pawl disposed in the second opening and engaging the ratchet gear, a reversing means subassembly pivotally mounted on the upwardly-projecting pivot pin and including a resiliently-biased detent member engaging respective detent pockets in the pawl, means for retaining the ratchet gear, pawl, and reversing means subassembly within the integral unitary handle.

24. In a ratchet wrench, the combination of a movable pawl cooperating with a ratchet gear, the pawl and the ratchet gear having respective parallel axes which are laterally displaced with respect to each other, the pawl being cylindrical and being rotatably journaled in a circular pawl opening, a manually-manipulatible reversing member for actuating the pawl, the reversing member having a cylindrical portion journaled for pivotal movement in a circular opening formed in the ratchet wrench, and a resiliently-biased detent member carried completely by the cylindrical portion of the reversing member and directly engaging the pawl for movement thereof.

25. The combination of claim 24, wherein the reversing member has an opening formed therein substantially perpendicular to the pivot axis of the reversing member, the opening having a closed end interiorly of the reversing member, and the detent member being received in the opening.

* * * * *